US011735808B2

(12) United States Patent
Howell

(10) Patent No.: US 11,735,808 B2
(45) Date of Patent: Aug. 22, 2023

(54) UNPOWERED WIRELESS SIGNAL AMPLIFICATION DEVICE

(71) Applicant: Jason T. Howell, Bettedorf, IA (US)

(72) Inventor: Jason T. Howell, Bettedorf, IA (US)

(73) Assignee: Jason T. Howell, Bettendorf, IA (US)

( * ) Notice: Subject to any disclaimer, the term of this patent is extended or adjusted under 35 U.S.C. 154(b) by 0 days.

(21) Appl. No.: 17/501,150

(22) Filed: Oct. 14, 2021

(65) Prior Publication Data

US 2022/0115766 A1 Apr. 14, 2022

Related U.S. Application Data

(60) Provisional application No. 63/091,752, filed on Oct. 14, 2020.

(51) Int. Cl.
*H01Q 1/24* (2006.01)
*H01Q 9/42* (2006.01)

(52) U.S. Cl.
CPC ..... *H01Q 1/241* (2013.01); *H01Q 9/42* (2013.01)

(58) Field of Classification Search
CPC ..... H01Q 1/24; H01Q 1/241; H01Q 1/22; H01Q 1/36; H01Q 9/28; H01Q 9/30; H01Q 9/40; H01Q 1/44
See application file for complete search history.

(56) References Cited

U.S. PATENT DOCUMENTS 4,485,385 A 11/1984 Ralston
6,049,315 A * 4/2000 Meyer ..... H04B 7/15571 343/895
2017/0055231 A1* 2/2017 Cook ..... H04L 43/16
2017/0346156 A1* 11/2017 Morris ..... H01Q 1/1271
2018/0062729 A1* 3/2018 Linehan ..... H05K 7/186

FOREIGN PATENT DOCUMENTS

CN 204652390 U 9/2015
CN 109326875 A 2/2019

OTHER PUBLICATIONS

International Search Report and Written Opinion in PCT/US2021/054911, dated Feb. 4, 2022.

* cited by examiner

*Primary Examiner* — Thai Pham
(74) *Attorney, Agent, or Firm* — Lewis Rice LLC

(57) ABSTRACT

Unpowered wireless signal amplification system that includes a monopole reception antenna and an amplification portion including a wire frame diamond formed from two flat, square wire frames. The unpowered wireless signal amplification system disclosed may be capable of receiving, amplifying, and transmitting wireless signals commonly used today, including multiple signal frequencies simultaneously.

16 Claims, 7 Drawing Sheets

UNPOWERED WIRELESS SIGNAL AMPLIFICATION DEVICE

CROSS REFERENCE TO RELATED APPLICATION(S)

This application claims benefit of U.S. Provisional Patent Application Ser. No. 63/091,752, filed Oct. 14, 2020. The entire disclosure of this document is herein incorporated by reference.

BACKGROUND

1. Field of the Invention

This disclosure is related to the field of improving wireless signal transmission and reception, and more particularly to systems and methods for improving the wireless signal strength of a mobile device or other wireless device.

2. Description of the Related Art

Wireless communication is truly ubiquitous today. Humans are capable of sending wireless signals across the world, and do so daily with little fanfare. Wireless communication began as early as the last 1800 s with simple radio transmitters and receivers. Over time, wireless signals used for radio communications, which are signals sent using waves within the radio frequencies (about 30 Hz to about 300 GHz), increased dramatically in their utilization. People have always desired to communicate remotely, and wireless signals, with their ability to carry information across distances both large and small, caught on quickly. The United States military was an early adopter of wireless communications, using the technology to communicate between troops in different locations and also between troops and various devices.

As technology advanced, people developed additional needs for wireless communications, many of which are personal-level communications directed at ordinary consumers. For example, cellphones and other mobile devices sometimes require cellular networks to communicate with the Internet or other devices. Mobile devices, as well as computers and other electronics, also may use wireless signals to communicate with other devices, such as other computers of computer peripherals. For example, many mobile devices use Wi-Fi, Bluetooth, or other wireless protocols to communicate between different devices. Today, wireless connections are used all over the electronic world to allow devices to communicate over distances both big and small.

A typical wireless system comprises a transmitter and a receiver. A transmitter is a device capable of transmitting a wireless signal into space, and a receiver is a device capable of receiving such a wireless signal. A transceiver is a device capable of both transmission and reception of wireless signals. Such wireless signals may be at one or more different wavelengths. To simplify discussions in this application, wireless signals will be discussed in terms of a single wavelength. However, this is not the only way that wireless signals may be communicated, as would be understood by persons of ordinary skill in the art.

A wireless signal, when transmitted from a transmitter, is a wave that propagates through space and typically includes information encoded on that wave. The propagation is often in every direction, but may also be directional in any amount. The wave then travels through space to a receiver.

Typically, there may be any number of receivers capable of receiving the wave. A receiver typically includes an antenna that is capable of receiving the wave, although the antenna may also receive any number of other waves at different wavelengths. The receiver then must filter out the intended wave from all of the waves received. Once the wave has been isolated, the receiver must finally decode the information coded on the intended wave. There are many different methods for encoding and decoding, and any known method may be used. The filters and decoders are typically made of some mixture of analog and digital circuits. In the end, the receiver is intended to receive a version of the originally encoded information that as transmitted. Often times, the goal for wireless communication systems is to provide the most fidelity possible between the original and received information. For example, when the information is the voice of another spoken into a telephone or mobile device communications systems, the person operating the relevant receiver typically would prefer to hear the incoming voice information clearly and without distortion.

People using wireless communication may encounter any of a number of problems during use. First and foremost, the curvature of the Earth interferes with the propagation of wireless signals, which radiate from a particular point and often do not efficiently bend around the curve. Further, wireless signals do not propagate indefinitely through space. These and other factors, coupled with the fact that a receiver must receive a wave with sufficient power to be read or the information will be lost, means that the availability of wireless communications may depend on the availability of sufficient signal power in the location of the receiver. Wireless signal power typically attenuates over distance. Similarly, wireless signals may attenuate when passing through objects such as walls, vegetation, or other structures. Further, although wireless signals are typically emitted from an antenna in every direction, they waves typically propagate linearly away from that antenna. Thus, at sufficient distances, wireless signals may be substantially directional. This directionality may cause certain structures or obstructions to create wireless shadows when they are placed between a transmitter and a receiver.

The above issues may be exacerbated by the physical placement and arrangement of transceiver antennas within a wireless system. For example, for wireless communications for cellphones in the United States, cellphone service providers have large networks of transceiver antennas placed strategically throughout the country. These antennas are typically fixed in space, and altering the placement of antennas in a network can be both expensive and unavailable to due to material costs and the availability of space to place the antennas. Thus, the availability of cellphone service in any given area may be dependent on how the relevant networks of transceiver antennas are arranged relative to that area. As a result, some areas have inferior cellphone services due to relatively large distances to nearby transceiver antennas or other geospatial issues. The problem that results from the fixed placement of networks of antennas may be further exacerbated by technical problems that occur with the transceivers, antenna, or other equipment needed to maintain the network. Similarly, these structures and systems may be physically damaged by sources including people and natural events. For example, a powerful storm may cause damage to transceiver antennas within a cellphone network. The result may be that some areas that previously were serviced by the damaged antennas may have insufficient cellphone service.

Similarly, wireless communication may have additional difficulties when the communications themselves rely upon direct, two-way communications. For example, when a driver is driving down a road in a rural town surrounding a city, the nearest cellphone tower may be a considerable distance away. In this example, the closest cellphone tower is located near a related highway, about a mile away. In this scenario, the driver must use direct, two-way communications between their cellphone and the nearest cellphone tower to successfully place a call. Information from the cellphone must be gathered and sent to the cellphone tower. Likewise, information from the cellphone tower must be gathered and sent to the cellphone. However, due to the line-of-sight and directional nature of wave propagation through space, some physical locations near the driver may be better than other locations at facilitating these exemplary wireless communications. For example, some portions of the area around the driver may be obstructed by buildings, by topographical features, or by some other source. Further, other factors may make the driver's vicinity into an area having significantly varied cellphone signal quality. Accordingly, there is a need in the art to provide more consistency in cellphone signal quality for a given local region of space.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein are, among other things, a wireless signal amplifying system, the system comprising: a body; a signal receiving portion including a first quarter wave antenna, the signal receiving portion being mounted on the body at a first location and the first quarter wave antenna having a monopole antenna having a first monopole length; an amplification portion including a first diamond structure formed from two square frames of wire, the amplification portion being mounted on the body at a second location that is remote from said first location and each square having sides having a first square side length; and an internal transmission portion that electrically connects the signal receiving portion to the amplification portion, wherein the two squares of the diamond structure are each connected at two opposite corners and are arranged orthogonally to form a diamond-like shape.

In an embodiment of the system, the two square frames of the diamond structure comprise galvanized steel.

In another embodiment of the system, the first monopole length is about equal to the first square side length.

In another embodiment of the system, there is a second diamond structure.

In another embodiment of the system, the second diamond structure is positioned proximate to, but electrically insulated from, the transmission portion.

In another embodiment of the system, the second diamond structure is the same size as the first diamond structure.

In another embodiment of the system, there is a second quarter wave antenna having a monopole antenna having a second monopole length; and a third diamond structure formed from two square frames of wire, each square having sides having a second square side length, wherein the two squares of the third diamond structure are each connected at two opposite corners and are arranged orthogonally to form a diamond-like shape.

In another embodiment of the system, the second monopole length is about equal to the second square side length.

In another embodiment of the system, the length of the first monopole length is equal to the second monopole length.

In another embodiment of the system, the length of the first monopole length is not equal to the second monopole length.

Also described herein, among other things, is a wireless signal amplifying system, the system comprising: a body; a signal receiving portion including a first quarter wave antenna, a second quarter wave antenna, a third quarter wave antenna, and a fourth quarter wave antenna, and wherein the signal receiving portion is mounted on the body; an amplification portion including a first diamond structure, a second diamond structure, a third diamond structure, and a fourth diamond structure, and wherein the amplification portion is mounted on the body; and an internal transmission portion that electrically connects the signal receiving portion to the amplification portion, wherein the first quarter wave antenna has a monopole antenna having a first monopole length, the second quarter wave antenna has a monopole antenna having a second monopole length, the third quarter wave antenna has a monopole antenna having a third monopole length, and the fourth quarter wave antenna has a monopole antenna having a fourth monopole length; wherein each of the first diamond structure, the second diamond structure, the third diamond structure, and the fourth diamond structure is formed from two square frames of wire connected at two opposite corners and arranged orthogonally to form a diamond-like shape; wherein the squares of the first diamond structure have a first square side length, the squares of the second diamond structure have a second square side length, the squares of the third diamond structure have a third square side length, and the squares of the fourth diamond structure have a first square side length; and wherein each of the first monopole length, the second monopole length, the third monopole length, and the fourth monopole length are different.

In another embodiment of the system, each of the first square side length, the second square side length, the third square side length, and the fourth square side length are different.

In another embodiment of the system, the body portion has a generally planar shape.

In another embodiment of the system, there is at least one nichrome wire attached to the monopole of the first quarter wave antenna, wherein the first monopole length is longer than or equal to two times the length of the wavelength intended to be transmitted or received.

In another embodiment of the system, one of the first monopole length, the second monopole length, the third monopole length, and the fourth monopole length is configured to receive and transmit 850 MHz wireless signals.

In another embodiment of the system, one of the first monopole length, the second monopole length, the third monopole length, and the fourth monopole length is configured to receive and transmit 700 MHz wireless signals.

DETAILED DESCRIPTION OF THE EMBODIMENT(S)

Figure 1:
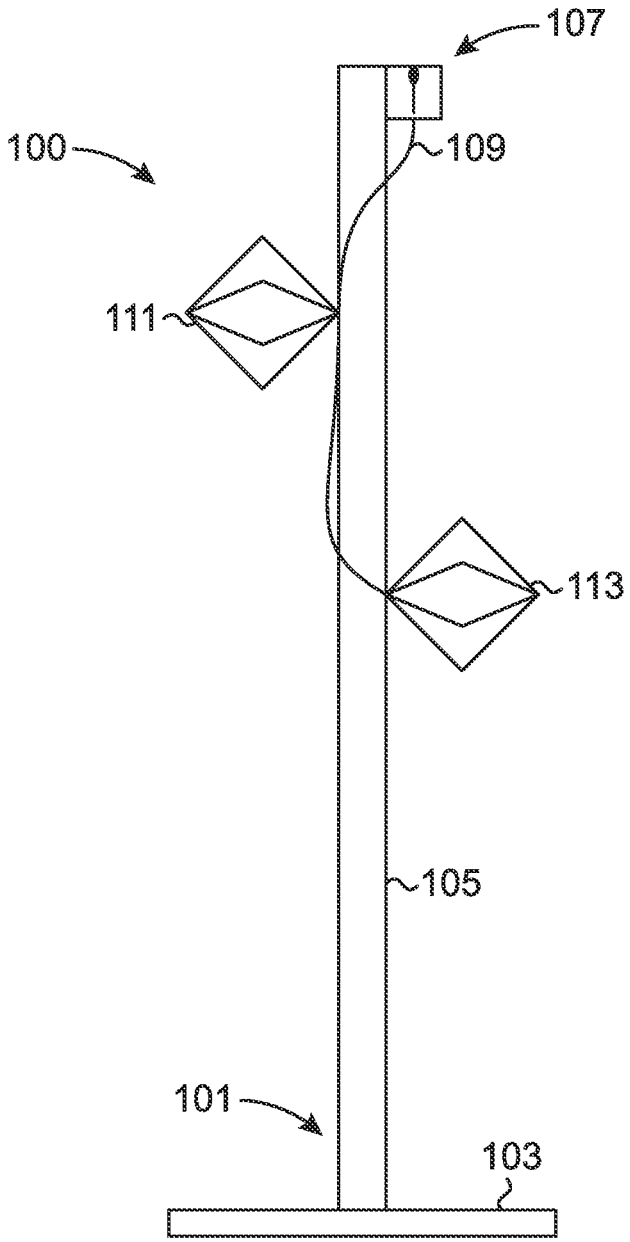
FIG. 1 depicts a side view of an embodiment of a system according to the present disclosure.

The following detailed description and disclosure illustrates by way of example and not by way of limitation. This description will clearly enable one skilled in the art to make and use the disclosed systems and methods, and describes several embodiments, adaptations, variations, alternatives, and uses of the disclosed systems and methods. As various changes could be made in the above constructions without departing from the scope of the disclosures, it is intended that all matters contained in the description or shown in the accompanying drawings shall be interpreted as illustrative and not in a limiting sense.

Generally speaking, described herein, among other things, are systems and methods for improving the wireless signal service of a device that uses wireless communication. Such wireless communication may use any frequency, standard, or wireless protocol. Generally speaking, the systems and methods described herein may improve the ability of wireless communications to occur even when wireless service is attenuated or altered due to wireless network issues.

Throughout this disclosure, the term "computer" describes hardware that generally implements functionality provided by digital computing technology, particularly computing functionality associated with microprocessors. The term "computer" is not intended to be limited to any specific type of computing device, but it is intended to be inclusive of all computational devices including, but not limited to: processing devices, microprocessors, personal computers, desktop computers, laptop computers, workstations, terminals, servers, clients, portable computers, handheld computers, cellphones, smart phones, tablet computers, mobile devices, server farms, hardware appliances, minicomputers, mainframe computers, video game consoles, handheld video game products, and wearable computing devices including, but not limited to, eyewear, wrist-wear, pendants, and clip-on devices.

As used herein, a "computer" is necessarily an abstraction of the functionality provided by a single computer device outfitted with the hardware and accessories typical of computers in a particular role. By way of example and not limitation, the term "computer" in reference to a laptop computer would be understood by one of ordinary skill in the art to include the functionality provided by pointer-based input devices, such as a mouse or track pad, whereas the term "computer" used in reference to an enterprise-class server would be understood by one of ordinary skill in the art to include the functionality provided by redundant systems, such as RAID drives and dual power supplies.

It is also well known to those of ordinary skill in the art that the functionality of a single computer may be distributed across a number of individual machines. This distribution may be functional, as where specific machines perform specific tasks; or, balanced, as where each machine is capable of performing most or all functions of any other machine and is assigned tasks based on its available resources at a point in time. Thus, the term "computer" as used herein, can refer to a single, standalone, self-contained device or to a plurality of machines working together or independently, including without limitation: a network server farm, "cloud" computing system, software-as-a-service, or other distributed or collaborative computer networks.

Those of ordinary skill in the art also appreciate that some devices that are not conventionally thought of as "computers" nevertheless exhibit the characteristics of a "computer" in certain contexts. Where such a device is performing the functions of a "computer" as described herein, the term "computer" includes such devices to that extent. Devices of this type include but are not limited to: network hardware, print servers, file servers, NAS and SAN, load balancers, and any other hardware capable of interacting with the systems and methods described herein in the matter of a conventional "computer."

For purposes of this disclosure, there will also be significant discussion of a special type of computer referred to as a "mobile device". A mobile device may be, but is not limited to, a smart phone, tablet computer, e-reader, or any other type of mobile computer. Generally speaking, the mobile device is network-enabled and communicating with a server system providing services over a telecommunication or other infrastructure network. A mobile device is essentially a mobile computer, but one that is commonly not associated with any particular location, is also commonly carried on a user's person, and usually is in near-constant communication with a network. Mobile devices also include wearable computers, including specialized computers, such as, but not limited to, watch computers (such as the Apple™ Watch), fitness trackers (such as a Fitbit™), interactive eyewear (such as Google™ Glass), smart clothing, and related items.

Throughout this disclosure, the term "network" generally refers to a voice, data, or other telecommunications network over which computers communicate with each other.

Throughout this disclosure, the term "transmitter" refers to equipment, or a set of equipment, having the hardware, circuitry, and/or software to generate and transmit electromagnetic waves carrying messages, signals, data, or other information. A transmitter may also comprise the componentry to receive electric signals containing such messages, signals, data, or other information, and convert them to such electromagnetic waves. The term "receiver" refers to equipment, or a set of equipment, having the hardware, circuitry, and/or software to receive such transmitted electromagnetic waves and convert them into signals, usually electrical, from which the message, signal, data, or other information may be extracted. The term "transceiver" generally refers to a device or system that comprises both a transmitter and receiver, such as, but not necessarily limited to, a two-way radio, or wireless networking router or access point. For purposes of this disclosure, all three terms should be understood as interchangeable unless otherwise indicated; for example, the term "transmitter" should be understood to imply the presence of a receiver, and the term "receiver" should be understood to imply the presence of a transmitter.

As used herein, the term "wireless signals" means any and all radiative energy that is typically known by persons of ordinary skill in the art to propagate in the form of a wave, including all electromagnetic radiation. This also includes all radio frequency signals.

As used herein, the terms "or" and "and/or" shall have the same meaning, which shall both have the meaning of an "inclusive or."

FIG. 1 depicts an embodiment of an unpowered wireless signal amplification device (100), which may also be referred to herein as an "UWSA device." As depicted in FIG. 1, the main components of the UWSA device (100) include a body portion (101), a reception portion, an internal transmission portion, and an amplification portion. In the depicted embodiment, the body portion (101) may include a base (103) and an upright column (105). Further, the reception portion may include a lead antenna (107), and the internal transmission portion may include a transmission wire (109). Finally, the amplification portion may include a first diamond structure (113) or a second diamond structure (111).

As stated above, the body portion (101) in the embodiment depicted in FIG. 1 may include a base (103) and an upright column (105). The body portion (101) may also include fasteners of any type (not shown) that may be used to connect the various components together. The components of the body portion (101) may be made from any material (or a composite of different materials) capable of supporting the other components of the UWSA device (100). Further, in some embodiments, the materials used to make the body portion (101) may be sufficiently strong and weather resistant to withstand extended periods of time outdoors. In many embodiments, the materials used to make the body portion (101) will be electrically insulative. In other embodiments, the other components of the UWSA device (100) may be electrically insulated from the body portion (101). In the depicted embodiment, the upright column (105) may be about four feet in length. However, in other embodiments, the upright column (105) may have any length. The base portion (103) and the upright column (105) may each have any shape. In the depicted embodiments, the base portion (103) is generally rectangular and the upright column (105) is generally a rectangular prism or a cylinder.

The reception portion may include a lead antenna (107) and a system to fasten the lead antenna (107) to the body portion (101). In the depicted embodiment, the lead antenna (107) is attached at or about the one end of the upright column (105), while the base (103) is attached at the opposite end of the upright column (105). In other embodiments, the lead antenna (107) may be positioned adjacent to the body portion (101), or at a point other than an end of the upright column (105). In yet other embodiments, the lead antenna (107) may be attached to the body portion (101) at any point and may have any orientation capable of receiving and transmitting wireless signals. Being attached at the end of the upright column (105) may have the advantage of providing superior access to wireless signals, especially when the wireless signals are transmitted or received at a point remote from the UWSA device (100).

In the depicted embodiment, the lead antenna (107) may be a quarter wave monopole antenna with a ground plane. In the depicted embodiment, the monopole antenna is a single piece of 8-gauge copper wire. In other embodiments, the monopole antenna may be any conductive material or combination of materials. Further, the ground plane depicted in FIGS. 1 and 4 includes four radials, each comprising a single piece of 8-gauge caper wire. In other embodiments, the radials may be any conductive material or combination of materials, and there may be more or less radials, as would be understood by a person of ordinary skill in the art. In some embodiments, such as those shown in FIG. 11, the ground plane includes 8 radials. In yet other embodiments, the ground plane may be anything capable of providing the requisite ground plane, as would be understood by a person of ordinary skill in the art. For example, any conducting surface sufficiently larger than the wavelength of and sufficiently reflecting of the wireless signals to be received or transmitted by the monopole antenna may be used, such as the Earth or a large conductive sheet. In some situations, the lead antenna (107) may be referred to as a "wave spider."

Figure 4:
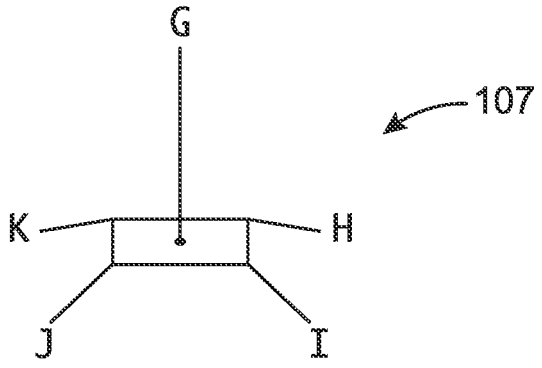
FIG. 4 depicts a top front view of an embodiment of a lead antenna that may be used in the embodiment of the system depicted in FIG. 1.
Figure 5:
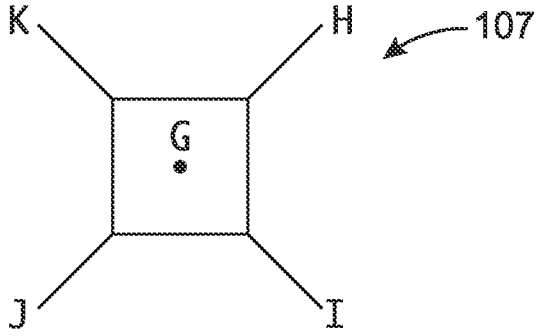
FIG. 5 depicts a top view of the lead antenna depicted in FIG. 4.

FIGS. 4 and 5 provide some detail on the orientation of the monopole antenna and ground plane having four radials of the lead antenna (107) of the embodiment of the UWSA device (100) depicted in FIG. 1. FIG. 4 depicts a top front view of the lead antenna (107). FIG. 5 depicts a top view of the lead antenna (107). The monopole antenna in FIGS. 4 and 5 is labeled with a "G". The four radials of the ground pane are labeled "H", "I", "J", and "K", respectively. As can be seen in FIGS. 4 and 5, the monopole antenna G extends in a vertical direction from a ground plane that serves as a base for the components of the lead antenna (107). The ground plane of the lead antenna (107) is depicted as a rectangle that exists a plane that is orthogonal to the vertical direction in which the monopole antenna G extends. In other embodiments, the ground plane may have any shape or orientation, as would be understood by persons of ordinary skill in the art. Typically, however, the ground plane will exist primarily in a plane that is orthogonal to the vertical direction in which the monopole antenna G extends.

In the depicted embodiment, the radials H, I, J, and K extend from the corners of the rectangular ground plane at an angle that is 45 degrees from the plane of the ground plane in a direction away from the ground plane on the opposite side of the ground plane of the side from which the monopole antenna G extends. In other embodiments, the radials may be attached at any portion of the ground plane and may extend in any direction. In some embodiments, the ground plane may be a socket (or include a socket) for connecting the components of the lead antenna (107) or for connecting the lead antenna (107) to the internal transmission portion.

In some embodiments, the monopole antenna G and each of the radials H, I, J, and K have the same length. In other embodiments, the monopole antenna G and any of the radials H, I, J, and K may have different lengths. Typically, each of the radials H, I, J, and K will have the same lengths. Further, the length of the monopole antenna G is typically selected by the device designer to efficiently absorb and transmit wireless signals of an intended frequency or small frequency range. In some embodiments, the lengths of any of the monopole antenna G and each of the radials H, I, J, and K may be adjustable. Such adjustment may be made via any means known to persons of ordinary skill in the art, such as, for example, the use of telescoping, extending, or replaceable conductors.

The internal transmission portion may include a transmission wire (109) and any other material or device capable of assisting with the transmission of signals received at the reception portion to the amplification portion. In the embodiment depicted in FIG. 1, the transmission wire (109) is a standard coaxial cable. However, in other embodiments, any conductive cable or conduit may be used, as would be understood by persons of ordinary skill in the art. A coaxial cable may offer some benefits, as it is a low-resistance, consistent-impedance, and shielded conductor. In the depicted embodiment, one end of the transmission wire is electrically and physically connected to the reception portion and the lead antenna (107). Where a socket is used as a component of the reception portion, the transmission wire (109) may connect directly to the socket. On the other end of the transmission wire (109) may be a first diamond structure (113). In the depicted embodiment, this other end of the transmission wire is electrically and physically connected to the amplification portion and the first diamond structure (113). Where a socket is used as a component of the amplification portion, the transmission wire (109) may connect directly to the socket. In some embodiments, such as the embodiment depicted in FIG. 1, there may be a second diamond structure (111) located proximate to the transmission wire (109) along the length of the wire. This second diamond structure (111) is not typically directly electrically connected to the transmission wire (109), although there may be an electric coupling through an air gap between the second diamond structure (111) and the transmission wire (109). The second diamond structure (111) may be placed at any point along the transmission wire (109), but will typically be placed around the middle of the length of the transmission wire (109). In some embodiments, there may be two or more first diamond structures (113). In such and embodiments, the transmission wire (109) may be directly connected to a coupler wire that couples the two or more first diamond structures to the transmission wire (109) and to each other.

Figure 2:
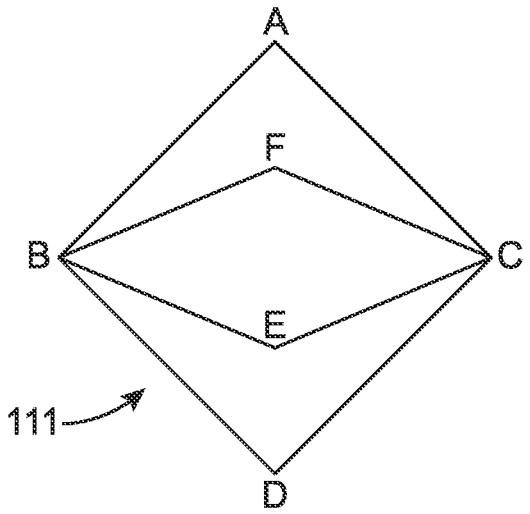
FIG. 2 depicts a top front view of an embodiment of a diamond structure that may be used in the embodiment of the system depicted in FIG. 1.
Figure 3:
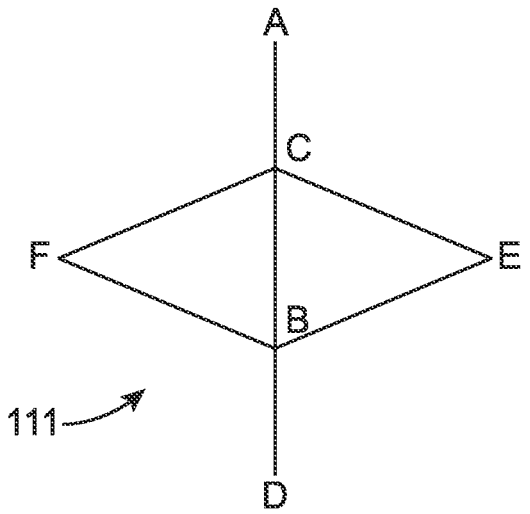
FIG. 3 depicts a top left view of the diamond structure depicted in FIG. 1.

The amplification portion in the embodiment depicted in FIG. 1 includes a first diamond structure (113) and a second diamond structure (111). In this embodiment, the first diamond structure (113) is the same as the second diamond structure except that the two are connected to the UWSA device (100) at different locations and only the first diamond structure (113) is directly electrically connected to the transmission wire (109). FIGS. 2 and 3 provide some detail on the orientation of the components of the second diamond structure (111) of the embodiment of the UWSA device (100) depicted in FIG. 1. FIG. 2 depicts a top front view of the second diamond structure (111), and FIG. 3 depicts a top left view of the second diamond structure (111). As can be seen in FIG. 2, the second diamond structure (111) has a generally diamond appearance that is formed from two squares (or generally shaped as squares), each square being generally formed as a wire frame. Said another way, each square only has its periphery formed by material, and the remainder is open to the environment. The first square itself is made from segments that are connected between points labeled "A", "B", "C", and "D". The second square is made from segments that are connected between points labeled B, C, "E", and "F". As depicted in FIG. 1, the points A, B, C, D, E, and F may describe the six corners of a regular octahedron. However, the second diamond structure (111) typically does not have any of the eight side surfaces that would make an octahedron. Instead, as depicted in FIGS. 2 and 3, only the two square peripheries discussed above are formed.

The material that makes the two squares may be any conductor. In the depicted embodiment, the squares are made from cylindrical segments of galvanized steel. In other embodiments, the material may be any conductive material including composite materials. In the depicted embodiment, the lengths of each segment of the second diamond structure (111) are equal in length. In other embodiments, not every segment need be equal in length. When used for cellular telephone service applications, each segment is typically about 5 inches in length. In the depicted embodiment, the segments are magnetized. For example, magnets may be incorporated into the second diamond structure (111) so that the overall device is magnetized. Such magnets may be neodymium magnets or any other magnets. Such magnets may be placed in close proximity to the second diamond structure (111), or other components of the USWA device (100) including without limitation the lead antenna (107).

The first diamond structure (113) will typically have the same dimensions and structure as the second diamond structure (111), as is the case in the embodiment the UWSA device (100) depicted in FIG. 1. The first diamond structure (113) functions typically to radiate the signals received at the reception portion to nearby wireless devices, such as a mobile device. Further, the first diamond structure (113) will typically receive signals from nearby wireless devices and transmit them to the reception portion, which may, in turn, transmit the wireless signals into the immediate area via the lead antenna (107). As a result, reception and transmission of wireless signals for a proximate wireless device may be improved.

Figure 6:
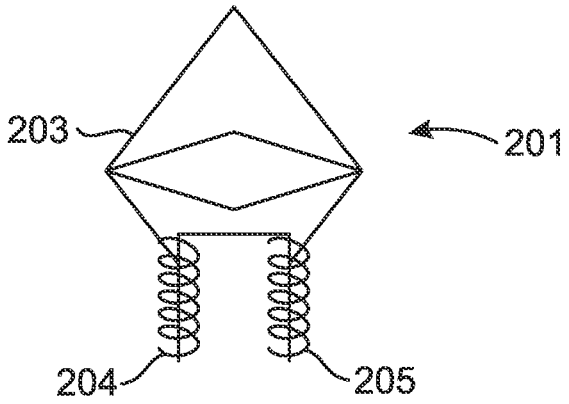
FIG. 6 depicts a second embodiment of a diamond structure.
Figure 7:
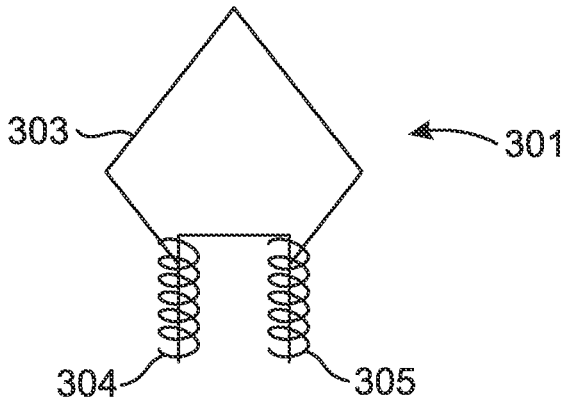
FIG. 7 depicts a third embodiment of a diamond structure.
Figure 8:
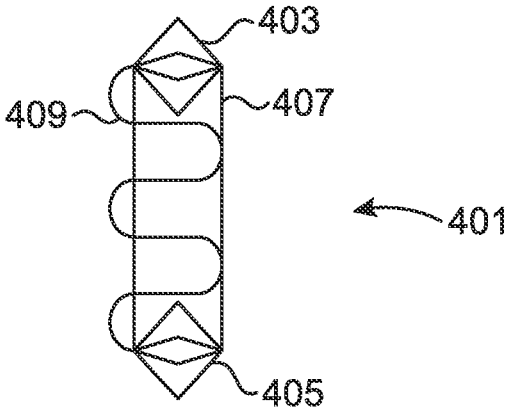
FIG. 8 depicts a fourth embodiment of a diamond structure.

FIGS. 6, 7, and 8 depict some alternate embodiments of the first diamond structure (113) or the second diamond structure (111). FIG. 6 depicts an embodiment of the first diamond structure (201) wherein one of the two squares is not closed. Instead, one of the corners of the vertical square is open, creating two ends. Each end is connected to one coil (204, 205), which may be made of any conductive material. These coils may then be connected to the internal transmission portion of the UWSA device (100). Similarly, the first diamond structure (303) depicted in FIG. 7 also includes a vertical square that has one corner that is open, creating two ends. These ends are also each connected to a coil (304, 305). In some embodiments of the first diamond structures (201, 301) depicted in FIGS. 6 and 7, the open ends of the square may include an electrical bridge between the open ends. This bridge may have any shape, construction, or arrangement.

FIG. 8 depicted a more complicated version of a first diamond structure (401). This first diamond structure (401) includes an alpha diamond structure (403) and a beta diamond structure (405), which diamond structures (403, 405) may be physically connected together via a frame (407) and electrically connected via a diamond structure wire (409). Here, the alpha diamond structure (403) and the beta diamond structure (405) may have any diamond structure construction discussed here or otherwise known to persons of ordinary skill in the art. In the embodiment depicted in FIG. 8, the alpha diamond structure (403) and the beta diamond structure (405) each have a construction like the first diamond structure (111) discussed above and shown in FIG. 1.

The frame (407) may have any construction and be made of any materials. In the depicted embodiment, the frame may consist of two beams attaching together the diamond structures (403, 405). Further, the frame (407) may be made of the same galvanized and magnetized steel material used to create the diamond structures (403, 405). The diamond structure wire (409) may be any conductive material. In the embodiment depicted in FIG. 8, the diamond structure wire (409) may be a coaxial cable. The embodiment of the diamond structure wire (409) depicted in FIG. 8 includes several bends across the frame as the wire propagates between the two diamond structure (403, 405). In other embodiments, other shapes and arrangements of the diamond structure wire (409) may be used.

Any of the above elements, including the diamond structures (111, 113) and the lead antenna (107) may be designed to have adjustable components. Specifically, the effective lengths of portions of these components may be adjustable, such as by including a telescoping feature. In any case, the length of the sides of these components may be designed, or adjusted, to most efficiently absorb or radiate preselected frequencies, as would be understood by a person of ordinary skill in the art.

The above-described UWSA device (100) may be used to improve access to wireless signals for mobile devices and other wireless devices. Specifically, the UWSA device (100) need only be installed, or placed, in a location to be used. The result of its presence may be increased access to wireless signals at the intended frequencies of the device. This improvement may exists for a certain area proximate to the UWSA device (100).

Figure 9:
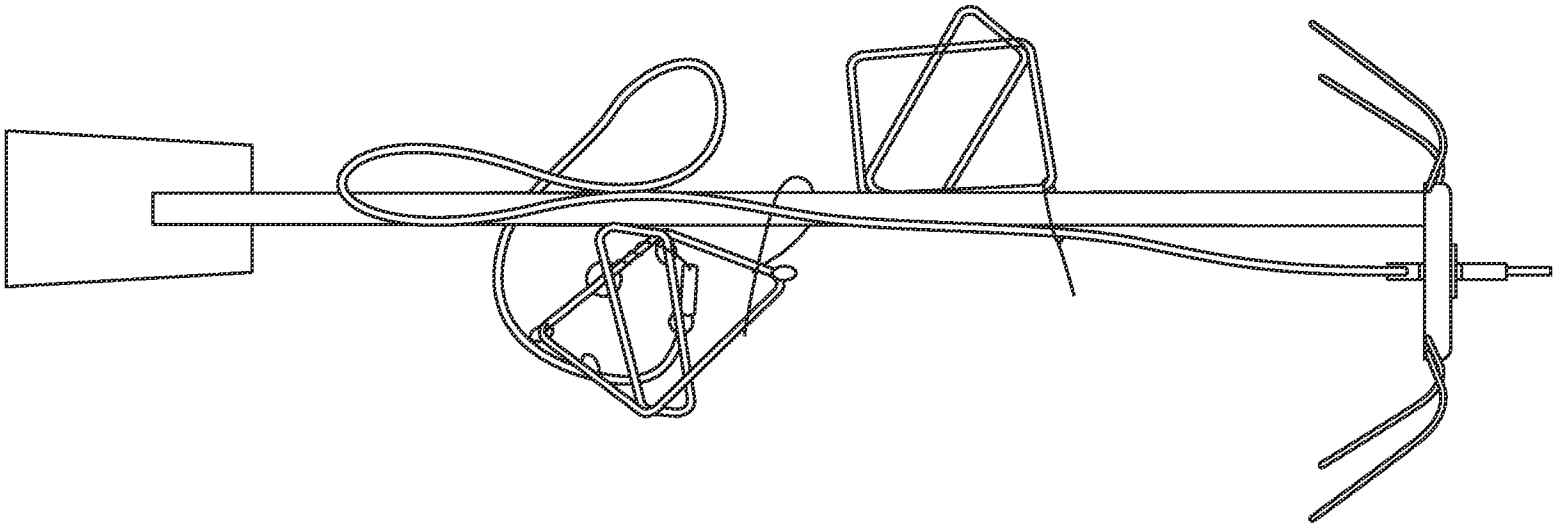
FIG. 9 depicts another embodiment of a system according to the present disclosure.
Figure 10:
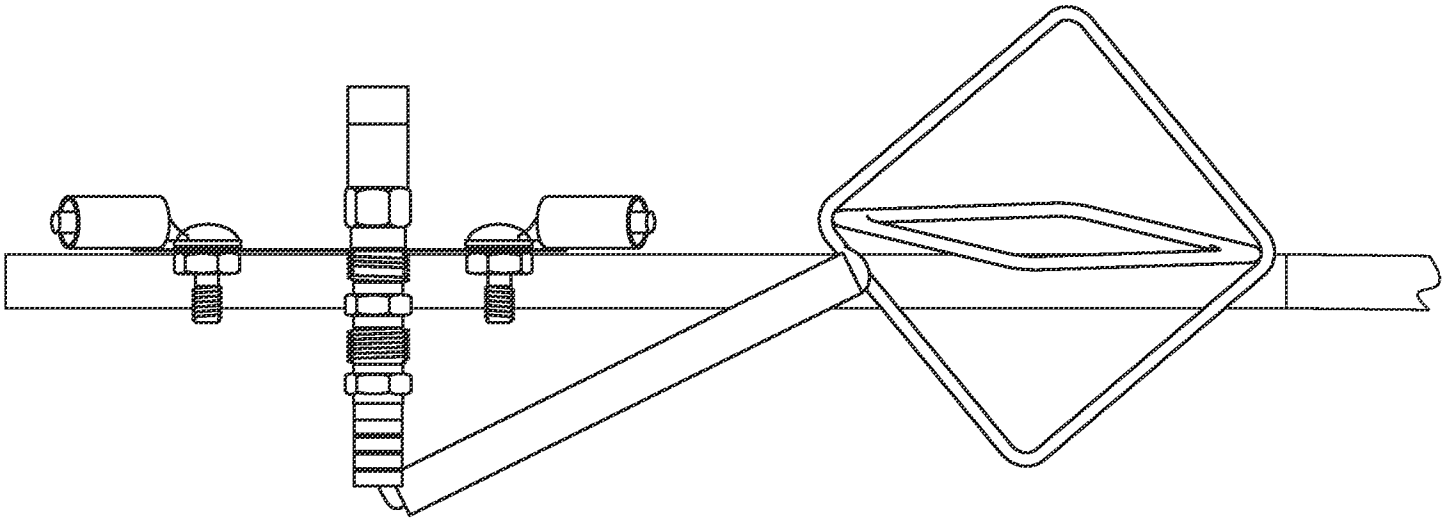
FIG. 10 depicts yet another embodiment of a system according to the present disclosure.

FIG. 9 depicts another embodiment of a system according to the present disclosure. FIG. 10 depicts yet another embodiment of a system according to the present disclosure. The device shown in FIG. 10 may include a one-eighth wave ground plane antenna having radials that extend in a direction parallel to the ground plane of an associated reception portion. As is true with any embodiment described herein, magnets may be placed anywhere on the device, such as on the base of the device or on a beam in or near a diamond structure. As can be seen in FIG. 10, a UWSA device may have a horizontal configuration. In other embodiments, the reception portion and the amplification portion may be remote from each other. For example, the reception portion may be placed on the roof of a vehicle, and the amplification portion may be placed within the vehicle.

Figure 11:
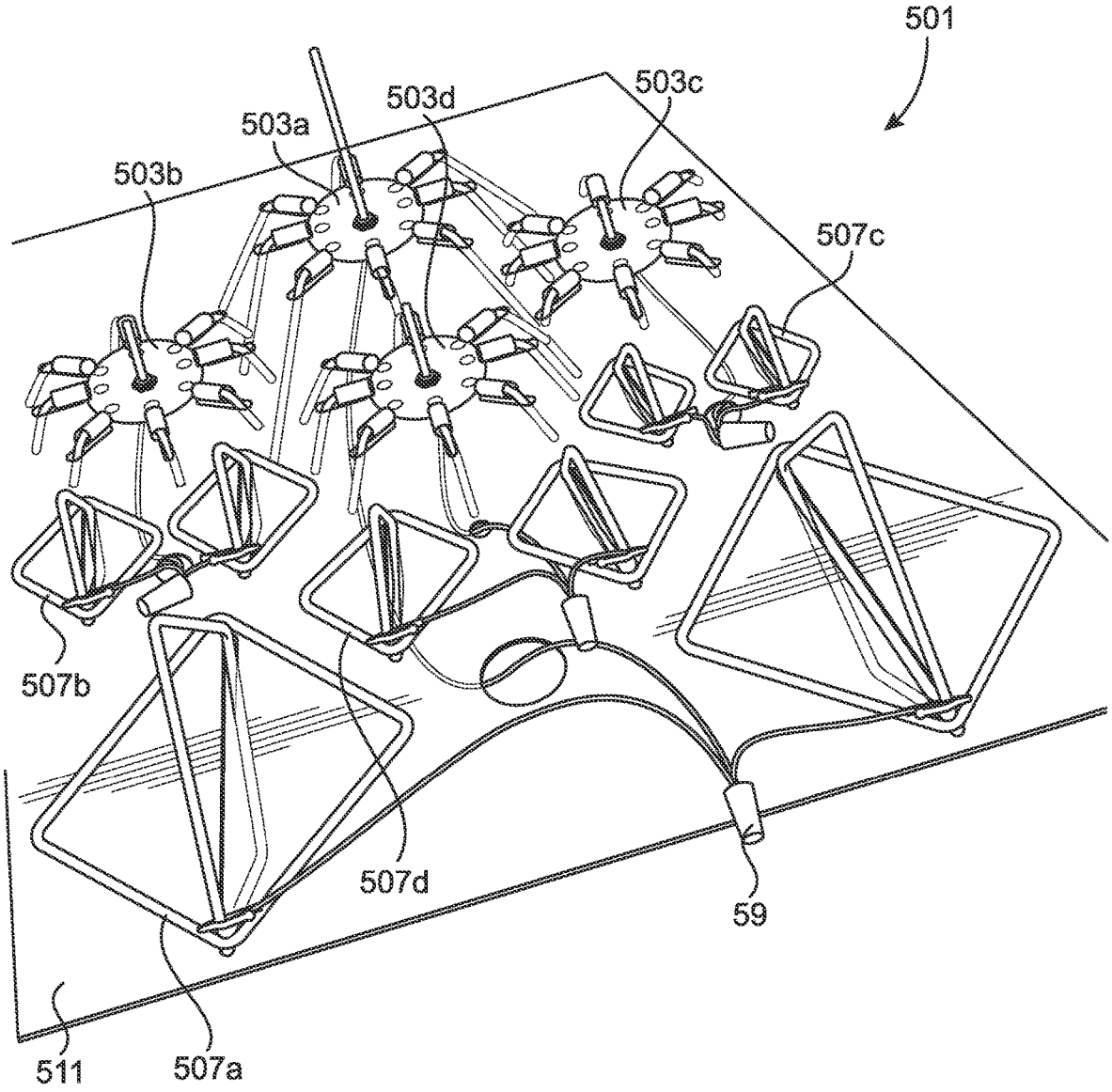
FIG. 11 depicts still another embodiment of a system according to the present disclosure.

FIG. 11 depicts still another embodiment of a UWSA device (501). In this embodiment, the main components of the UWSA device (501) include a body portion (511), a reception portion (503), an internal transmission portion (509), and an amplification portion (507). Similar to the embodiments of a UWSA device (100) discussed above, the body portion (511) depicted in FIG. 11 is intended to carry and position the other components of the UWSA device (501). However, as shown in FIG. 11, the body portion (511) has a different layout and construction. In this embodiment, the body portion (511) is a relatively flat plate of electrically insulating material that includes holes or other features to retain the other components of the UWSA device (100). In some embodiments, the body portion (511) may be made of acrylic, abs, or any other type of plastic. In other embodiments, the body portion (511) may be constructed of any material or composite of materials that provides sufficient strength to support the other components of the UWSA device (501), and the material(s) will typically be electrically insulating. In the depicted embodiment, the body portion is about 20 inches deep, ½ inch thick, and 13 inches wide. However, any specific dimensions may be used, as would be understood by a person of ordinary skill in the art. Further, any design or construction that provides some support for some of the components may be used.

The UWSA device (501) depicted in FIG. 11 also includes a reception portion (503) having four sub-units (503*a*, 503*b*, 503*c*, 503*d*) and an amplification portion (509) having four sub-units (507*a*, 507*b*, 507*c*, 507*d*). Each sub-unit in the reception portion (503) is electrically connected to a sub-unit in the amplification portion (507) via a portion of the internal transmission portion (509) under the body portion (511) using conductors (partially shown in FIG. 11). The conductors of the internal transmission portion (509) may be similar to those discussed above. Typically, each sub-unit pair from the in the reception portion (503) and the amplification portion (507) is not directly electrically connected to the other sub-unit pairs. Without limiting the scope of the inventions disclosed herein, each sub-unit pair from the in the reception portion (503) and the amplification portion (507) is similar to a simple UWSA device (100) shown in FIG. 1, but without a second diamond structure (111) and having two first diamond structures (113) that are electrically connected to each other at a facet (which is a side length of a square) or angle (which is a corner of a square) of each first diamond structure (113).

In this embodiment, each reception portion sub-unit (503*a*, 503*b*, 503*c*, 503*d*) may be similar to the lead antenna (107) discussed above with reference to other embodiments of the UWSA device (100). For example, each reception portion sub-unit (503*a*, 503*b*, 503*c*, 503*d*) may be a quarter wave monopole antenna with a ground plane and any number of radials. In the embodiment depicted in FIG. 11, there are eight radials placed around each ground plane for each reception portion (503). In the embodiment depicted in FIG. 11, there are a total of four reception portion sub-units (503*a*, 503*b*, 503*c*, 503*d*). Further, FIG. 11 shows that each of the lengths of the monopole antennae of each reception portion (503*a*, 503*b*, 503*c*, 503*d*) are different from each other. In other embodiments, the lengths may be the same or different. Typically, however, the length of each monopole antenna will differ in order to selectively amplify received signals of different strengths. This will be discussed in more detail below. Overall, the reception portion (503) is typically capable of both transmitting and receiving information via wireless signals.

As stated above, each reception portion sub-unit (503*a*, 503*b*, 503*c*, 503*d*) is directly electrically connected to one of four amplification portion sub-units (507*a*, 507*b*, 507*c*, 507*d*) of the amplification portion (507). In this embodiment, each amplification portion sub-unit (507*a*, 507*b*, 507*c*, 507*d*) may be similar to the amplification portion discussed above with reference to other embodiments of the UWSA device (100). For example, each amplification portion sub-units (507*a*, 507*b*, 507*c*, 507*d*) may be similar to having two first diamond structures (113) that are electrically connected to each other at an angle or facet of each first diamond structure (113). Each diamond structure of each the amplification portion sub-units (507*a*, 507*b*, 507*c*, 507*d*) may be mounted on the body portion (511) at one of its square wire frames that constitute the wireframe diamond. Further, FIG. 11 shows that each of the lengths of the sides of each diamond structure within each amplification portion sub-unit (507*a*, 507*b*, 507*c*, 507*d*) are different from the diamond structures of the other amplification portion sub-units (507*a*, 507*b*, 507*c*, 507*d*). In other embodiments, the lengths may be the same or different. Typically, however, the length of each sides of each diamond structure within each amplification portion sub-unit (507*a*, 507*b*, 507*c*, 507*d*) will differ between sub-units in order to selectively amplify received signals of different strengths.

As discussed above, in some embodiments, the lengths of the monopole antennae of each reception portion sub-unit (503*a*, 503*b*, 503*c*, 503*d*) and the lengths of the sides of each diamond structure within each amplification portion sub-unit differ in order to selectively receive and amplify predetermined wavelengths of wireless signals. In some embodiments, a given monopole antenna may have a length of about one quarter of the predetermined wavelength. In other embodiments, a given monopole antenna may have a length within five percent of one quarter of the predetermined wavelength. In yet other embodiments, especially those with very small wavelengths, a given monopole antenna may have a length of about two to three times the predetermined wavelength. In such a case, certain additional steps may be taken to ensure proper functioning. For example, the impedance of the monopole antenna may be reduced, by, for example, attaching a nichrome coil to the monopole antenna. Similarly, in typical embodiments, the lengths of the sides of each diamond structure within each amplification portion sub-unit (507*a*, 507*b*, 507*c*, 507*d*) will have the same length as its related monopole antennae of the related reception portion sub-unit (503*a*, 503*b*, 503*c*, 503*d*). In some embodiments, these lengths may not be exactly the same, but will be approximately equal. Further, in some embodiments, especially in embodiments where the lengths are larger than their corresponding predetermined wavelengths, certain additional steps may be taken to ensure proper functioning. For example, the impedance of a diamond structure may be reduced, by, for example, attaching a nichrome coil to the diamond structure.

By having a variety of sizes, the UWSA device (501) may be able to receive, amplify, and transmit a range of different wireless signals. In some embodiments, the UWSA device (501) may be design to accommodate at least the following wireless services: WiFi 2.4 GHz; WiFi 5 GHz; USC/T-Mobile 5G (600 MHz); Verizon LTE (700 MHz); Verizon 5G (2.3 GHz); 5G 28 GHz; 5G 39 GHz; HAM 140 (140 MHz); T-Mobile 4G (1.9 GHz); T-Mobile 5G (2.5 GHz); Drone (900 MHz); 4G "Unicorn" Frequency (1.7 GHz); EMS 154 (154 MHz); EMS 450 (450 MHz); EMS 850, AT&T 5G Low Band, and Cricket GSM/PCS/EDGE (850 MHz); and CBRS (3.5 GHz). In some embodiments, the UWSA device (501) may accommodate four of the above signal frequencies.

As is true for other embodiments, the USWA device (501) depicted in FIG. 11 may include any number of magnets may be placed within close proximity, which may result in performance gains. In some embodiments, the magnets may be formed into a circular ring (or other shape) under the body portion (511). Such an arrangement may create an electron tornado within and around the USWA device (501), which may result in performance gains.

In other embodiments, more or less reception portion sub-unit and amplification portion sub-unit pairs may be included. More or less diamond structures may be used in each monopole antenna/diamond structure pair. In other embodiments, the layout of the UWSA device (501) may be different, including vertical layouts. In other embodiments, the internal transmission portion may take any form that allows for the transmission of wireless signals from the reception portion (503) to the amplification portion (507). In some embodiments, there may be direct electrical contact between separate reception portion sub-unit and amplification portion sub-unit pairs.

In some embodiments, the UWSA device (100, 501) may be in the form of a portable device. In other embodiments, the UWSA device (100, 501) may be mountable to a vehicle or other carrier. In yet other embodiments, the UWSA device (100, 501) may be designed to be fixed to a structure. In any case, the UWSA device (100, 501) will typically be capable of receiving wireless signals from a distant source and amplifying that signal for the area local to the UWSA device (100, 501).

Without being bound by any particular theory of operation, the UWSA devices (100, 501) disclosed herein typically use a mix of metallic materials fabricated in a precise manner, allowing the devices to amplify wireless signals in a fashion similar to how solid state devices amplify power. These powerless amplification devices operates at a quantum level. For example, these devices may capitalize on the quantum superposition of standing waves, converting waves from traveling to standing then back to traveling waves—the amplification typically occurs when the wave is standing. Typically, without limitation, the positive byproduct of this powerless amplification means there is no noise or interference created by the devices, allowing the devices to amplify in a clean manner. Taking this one step further, the devices not only amplify signals, but, in some embodiments, may also clean (remove signal noise or interference) and spread the amplified signal outwards. As a further benefit, there is no power required for operation, and, accordingly, there is no software or firmware, making them hackproof passive devices that typically require little to no administration or configuration.

While the invention has been disclosed in conjunction with a description of certain embodiments, including those that are currently believed to be preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

It will further be understood that any of the ranges, values, properties, or characteristics given for any single component of the present disclosure can be used interchangeably with any ranges, values, properties, or characteristics given for any of the other components of the disclosure, where compatible, to form an embodiment having defined values for each of the components, as given herein throughout. Further, ranges provided for a genus or a category can also be applied to species within the genus or members of the category unless otherwise noted.

Finally, the qualifier "generally," and similar qualifiers as used in the present case, would be understood by one of ordinary skill in the art to accommodate recognizable attempts to conform a device to the qualified term, which may nevertheless fall short of doing so. This is because terms such as "square" are purely geometric constructs and no real-world component is a true "square" in the geometric sense. Variations from geometric and mathematical descriptions are unavoidable due to, among other things, manufacturing tolerances resulting in shape variations, defects and imperfections, non-uniform thermal expansion, and natural wear. Moreover, there exists for every object a level of magnification at which geometric and mathematical descriptors fail due to the nature of matter. One of ordinary skill would thus understand the term "generally" and relationships contemplated herein regardless of the inclusion of such qualifiers to include a range of variations from the literal geometric meaning of the term in view of these and other considerations.

I claim:

1. A wireless signal amplifying system, the system comprising:

a body;

a signal receiving portion including a first quarter wave antenna, the signal receiving portion being mounted on the body at a first location and the first quarter wave antenna having a first monopole antenna having a first monopole length;

an amplification portion including a first diamond structure formed from two square frames of wire, the amplification portion being mounted on the body at a second location that is remote from said first location and each square having sides having a first square side length; and an internal transmission portion that electrically connects the signal receiving portion to the amplification portion, the internal transmission portion including a conductor, wherein the two squares of the diamond structure are each connected at two opposite corners and are arranged orthogonally to form a diamond-like shape.

2. The wireless signal amplifying system of claim 1, wherein the two square frames of the diamond structure comprise galvanized steel.

3. The wireless signal amplification system of claim 1, wherein the first monopole length is about equal to the first square side length.

4. The wireless signal amplifying system of claim 1, wherein the amplification portion further comprises a second diamond structure formed from two square frames of wire.

5. The wireless signal amplifying system of claim 4, wherein the second diamond structure is positioned proximate to, but electrically insulated from, the transmission portion.

6. The wireless signal amplifying system of claim 5, wherein the second diamond structure is the same size as the first diamond structure.

7. The wireless signal amplifying system of claim 4, wherein the signal receiving portion further comprises a second quarter wave antenna having a second monopole antenna having a second monopole length; and wherein the amplification portion further comprises a third diamond structure formed from two square frames of wire, each square having sides having a second square side length, wherein the two squares of the third diamond structure are each connected at two opposite corners and are arranged orthogonally to form a diamond-like shape.

8. The wireless signal amplifying system of claim 7, wherein the second monopole length is about equal to the second square side length.

9. The wireless signal amplifying system of claim 8, wherein the length of the first monopole length is equal to the second monopole length.

10. The wireless signal amplifying system of claim 8, wherein the length of the first monopole length is not equal to the second monopole length.

11. A wireless signal amplifying system, the system comprising:

a body;

a signal receiving portion including a first quarter wave antenna, a second quarter wave antenna, a third quarter wave antenna, and a fourth quarter wave antenna, and wherein the signal receiving portion is mounted on the body at a first location;

an amplification portion including a first diamond structure, a second diamond structure, a third diamond structure, and a fourth diamond structure, and wherein the amplification portion is mounted on the body at a second location; and an internal transmission portion that electrically connects the signal receiving portion to the amplification portion, the internal transmission portion including a conductor, wherein the first quarter wave antenna has a first monopole antenna having a first monopole length, the second quarter wave antenna has a second monopole antenna having a second monopole length, the third quarter wave antenna has a third monopole antenna having a third monopole length, and the fourth quarter wave antenna has a fourth monopole antenna having a fourth monopole length;

wherein each of the first diamond structure, the second diamond structure, the third diamond structure, and the fourth diamond structure is formed from two square frames of wire connected at two opposite corners and arranged orthogonally to form a diamond-like shape;

wherein the squares of the first diamond structure have a first square side length, the squares of the second diamond structure have a second square side length, the squares of the third diamond structure have a third square side length, and the squares of the fourth diamond structure have a first square side length; and wherein each of the first monopole length, the second monopole length, the third monopole length, and the fourth monopole length are different.

12. The wireless signal amplification portion of claim 11, wherein the first square side length, the second square side length, the third square side length, and the fourth square side length are different.

13. The wireless signal amplification portion of claim 11, wherein the body portion has a generally planar shape.

14. The wireless signal amplification portion of claim 11, further comprising at least one nichrome wire attached to the monopole of the first quarter wave antenna, wherein the first monopole length is longer than or equal to two times the length of the wavelength intended to be transmitted or received.

15. The wireless signal amplification portion of claim 11, wherein one of the first monopole length, the second monopole length, the third monopole length, and the fourth monopole length is configured to receive and transmit 850 MHz wireless signals.

16. The wireless signal amplification portion of claim 15, wherein one of the first monopole length, the second monopole length, the third monopole length, and the fourth monopole length is configured to receive and transmit 700 MHz wireless signals.

* * * * *